United States Patent [19]

Kanda et al.

[11] Patent Number: 4,770,973

[45] Date of Patent: Sep. 13, 1988

[54] HEAT-SENSITIVE DIAZO RECORDING MATERIAL WITH DIPHENYL ALKENE COUPLER

[75] Inventors: Nobuo Kanda, Hirakata; Katsuhiko Ishida, Takatsuki; Tosaku Okamoto, Osaka; Mitsuru Kondo, Hyogo, all of Japan

[73] Assignee: Kanzaki Paper Manufacturing Limited, Tokyo, Japan

[21] Appl. No.: 928,050

[22] Filed: Nov. 7, 1986

[30] Foreign Application Priority Data

Nov. 15, 1985 [JP] Japan ..... 60-256874

[51] Int. Cl.[4] ..... G03C 1/58; B41M 5/18

[52] U.S. Cl. ..... 430/171; 430/138; 430/151; 430/182; 503/214; 503/218

[58] Field of Search ..... 430/182, 171, 151, 138; 503/218, 214

[56] References Cited

U.S. PATENT DOCUMENTS

| | | | |
|---|---|---|---|
| 1,966,755 | 6/1934 | D'Hauterive | 430/171 |
| 3,533,792 | 10/1970 | Petro et al. | 430/337 |
| 3,778,274 | 12/1973 | Inove et al. | 430/175 |
| 4,142,898 | 3/1979 | Izu | 430/158 |
| 4,486,527 | 12/1984 | Kurisu et al. | 430/158 |
| 4,641,160 | 2/1987 | Kondo et al. | 427/151 |
| 4,652,512 | 3/1987 | Ishida et al. | 430/179 |

OTHER PUBLICATIONS

Kosar, J., *Light-Sensitive Systems*, 1965, John Wiley and Sons, Inc., pp. 215, 219, 267 and 269.

*Primary Examiner*—Charles L. Bowers, Jr.
*Attorney, Agent, or Firm*—Murray & Whisenhunt

[57] ABSTRACT

In a heat-sensitive recording material which comprises a substrate and a heat-sensitive recording layer thereon containing a diazonium salt and coupler compound, the heat-sensitive recording material characterized in that the coupler compound comprises at least one compound represented by the formula [I] below

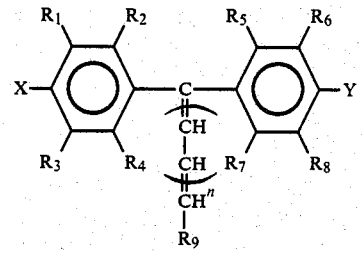

[I]

wherein $R_1$, $R_2$, $R_3$, $R_4$, $R_5$, $R_6$, $R_7$ and $R_8$ are each hydrogen atom, halogen atom, alkyl or alkoxyl; $R_9$ is hydrogen atom or alkyl; X and Y are each hydrogen atom, $—OR_{10}$ or $—N(R_{11})(R_{12})$, $R_{10}$, $R_{11}$ and $R_{12}$ being each hydrogen atom, alkyl, alicyclic group, aryl or aralkyl, these $R_{10}$, $R_{11}$ and $R_{12}$ may have a substituent selected from among halogen atom, alkyl and alkoxy, $R_{11}$ and $R_{12}$ may link together to form a heteroring, or, one or both of $R_{11}$ and $R_{12}$ may form a heteroring together with an adjacent benzene ring; n is 0 or 1.

7 Claims, No Drawings

HEAT-SENSITIVE DIAZO RECORDING MATERIAL WITH DIPHENYL ALKENE COUPLER

The invention relates to a heat-sensitive recording material, and more particularly to a heat-sensitive recording material which forms record images readable by optical character-reading devices and is fixable with light.

Heat-sensitive recording materials are well known which are adapted to record informations by contacting with heat or like energy a colorless basic dye with an organic or inorganic electron accepting reactant material for a color forming reaction.

Since the above heat-sensitive recording materials form record images with heat, they produce a color, even after printing, in portions which are heated with an inadvertent access of heat sources. As a result, they have a disadvantage that the printed letters could become illegible and thus hardly applicable to an important use in which the printed document has to be preserved.

In recent years, therefore, fixable heat-sensitive recording materials which utilize a color forming reaction between a diazonium salt and coupler compound have been developed as disclosed in, for example, U.S. Pat. Nos. 4387150, 4411979, 4454521, 4486527, 4487826, 4511642 and 4542394.

Generally, in the diazo-type heat-sensitive recording materials are formed record images having various colors such as blue, red, yellow, black depending on the combination of a diazonium salt, coupler compound, auxiliary color former (basic compound), etc.

With a trend toward more efficient office work in recent years, optical character-reading devices are in greatly increasing use for reading the record images on record media. The record images on the conventional diazo-type heat-sensitive recording sheet are legible as a leading color by optical character-reading devices having a reading wavelength range over the visible region (400 to 700 nm), but for optical character-reading devices having a reading wavelength range over the infrared region (700 to 900 nm), such images function as drop-out color irrespective of the color of the image and can not be read by the devices.

Record media for use with optical character-reading devices are generally in the form of slips. These slips have printed thereon instructions for recording data, frames for items, lines and descriptive characters. The ink to be used for printing must be of drop-out color so as not to hamper reading of the record images, but when the slip is used for an optical character-reading devices having a reading wavelength range over the visible region, the kind and amount of ink to be used must be determined with full care. If otherwise, the print would affect reading. To avoid the cumbersome procedure, optical character-reading devices having reading wavelengths in the infrared region are in growing use, and a wide variety of such devices have been developed.

An object of the invention is to provide a heat-sensitive recording material which employs a diphenylalkene derivative as a coupler compound and which is fixable and forms record images readable by optical character-reading devices having a reading wavelength range over the infrared region.

The above and other objects of the invention will become apparent from the following description.

In a heat-sensitive recording material which comprises a substrate and a heat-sensitive recording layer thereon containing a diazonium salt and coupler compound, the present invention provides a heat-sensitive recording material characterized in that the coupler compound comprises at least one compound represented by the formula [I] below

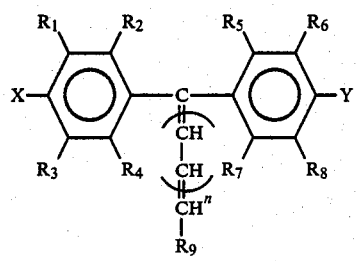

[I]

wherein $R_1$, $R_2$, $R_3$, $R_4$, $R_5$, $R_6$, $R_7$ and $R_8$ are each hydrogen atom, halogen atom, alkyl or alkoxyl; $R_9$ is hydrogen atom or alkyl; X and Y are each hydrogen atom, $—OR_{10}$ or $—N(R_{11})(R_{12})$, $R_{10}$, $R_{11}$ and $R_{12}$ being each hydrogen atom, alkyl, alicyclic group, aryl or aralkyl, these $R_{10}$, $R_{11}$ and $R_{12}$ may have a substituent selected from among halogen atom, alkyl and alkoxyl, $R_{11}$ and $R_{12}$ may link together to form a heteroring, or, one or both of $R_{11}$ and $R_{12}$ may form a heteroring together with an adjacent benzene ring; n is 0 or 1.

In the above, for example, when X and Y are both $—OR_{10}$, $R_{10}$ in X may be same or different from $R_{10}$ in Y. Similarly, when X and Y are both $—N(R_{11})(R_{12})$, $R_{11}$ or $R_{12}$ in X may be same or different from $R_{11}$ or $R_{12}$ in Y, respectively.

The diphenylalkene derivative of the formula [I] used as a coupler compound in the invention is a colorless or pale-colored compound. The derivative reacts with a diazonium salt to form an azo dye having a high color density which exhibits a light absorption over the infrared region of 700 to 900 nm.

In the above, alkyl and alkoxyl have preferably 1 to 8 carbon atoms, alicyclic group preferably 5 to 12 carbon atoms, aryl preferably 6 to 15 carbon atoms and aralkyl preferably 7 to 15 carbon atoms.

Among the above compounds of the formula [I], those in which at least one of X and Y is $—N(R_{11})(R_{12})$ are preferable which can form an azo dye having a light absorption over the near infrared region which is long in wavelength. Particularly, the compounds of the formula [II] below are more preferable, since they are easily available and react with a diazonium salt to form an azo dye having a light absorption over the near infrared region which is still longer in wavelength than the above.

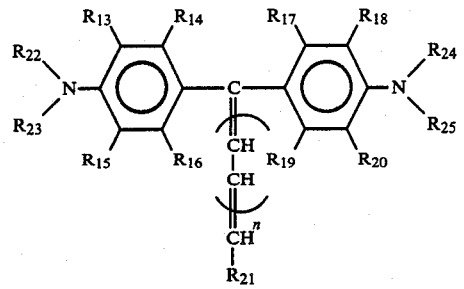

[II]

wherein $R_{13}$, $R_{14}$, $R_{15}$, $R_{16}$, $R_{17}$, $R_{18}$, $R_{19}$ and $R_{20}$ are each hydrogen atom, halogen atom, $C_1$–$C_4$ alkyl or $C_1$–$C_4$ alkoxyl; $R_{21}$ is hydrogen atom or methyl; $R_{22}$, $R_{23}$, $R_{24}$ and $R_{25}$ are each hydrogen atom, $C_1$–$C_4$ alkyl, $C_5$–$C_6$ cycloalkyl, phenyl or benzyl, said phenyl or benzyl being unsubstituted or substituted with halogen atom, $C_1$–$C_2$ alkyl or $C_1$–$C_2$ alkoxyl, both $R_{22}$ and $R_{23}$, and both $R_{24}$ and $R_{25}$ may link together to form 5 to 7 membered heteroring; n is 0 or 1.

Among the compounds of the formula [I], those in which n is zero and/or $R_9$ is hydrogen atom are preferable because they are easily prepared industrially.

The diphenylalkene derivative of the formula [I] having excellent properties as above is easily prepared by a conventional method as disclosed in Experimental Chemical Course (published by Maruzen Co. Ltd.), vol. 19, pages 1 to 31 (1959), etc. Examples of useful derivatives are shown below but not limited thereto.

1,1-Bis(4-aminophenyl)ethylene, 1,1-bis(4-methylaminophenyl)ethylene, 1,1-bis(4-dimethylaminophenyl)ethylene, 1,1-bis(4-ethylaminophenyl)ethylene, 1,1-bis(4-diethylaminophenyl)ethylene, 1,1-bis(4-dimethylaminophenyl)-1-propene, 1,1-bis(4-diethylaminophenyl)-1-propene, 1,1-bis(4-dimethylamino-2-methylphenyl)ethylene, 1,1-bis(4-diethylamino-2-methylphenyl)ethylene, 1,1-bis(4-dimethylamino-2-methoxyphenyl)ethylene, 1,1-bis(4-diethylamino-2-methoxyphenyl)ethylene, 1,1-bis{4-(N-methyl-N-benzyl)aminophenyl}ethylene, 1,1-bis{4-(N-ethyl-N-benzyl)aminophenyl}ethylene, 1,1-bis{4-(N-ethyl-N-p-chlorobenzyl-)aminophenyl}ethylene, 1,1-bis{4-(N-methyl-N-phenyl-)aminophenyl}ethylene, 1,1-bis{4-(N-methyl-N-p-tolyl-)aminophenyl}ethylene, 1,1-bis{4-(N-methyl-N-p-methoxyphenyl)aminophenyl}ethylene, 1,1-bis{4-(N-ethyl-N-p-methoxyphenyl)aminophenyl}ethylene, 1,1-bis(4-dimethylamino-2-methylphenyl)-1-propene, 1,1-bis(4-diethylamino-2-methylphenyl)-1-propene, 1,1-bis(4-dimethylamino-2-methoxyphenyl)-1-propene, 1,1-bis(4-diethylamino-2-methoxyphenyl)-1-propene, 1,1-bis(4-pyrrolidinophenyl)ethylene, 1,1-bis(4-piperidinophenyl)ethylene, 1,1-bis(4-morpholinophenyl)ethylene, 1,1-bis(4-hexamethyleneiminophenyl)ethylene, 1,1-bis(2-methyl-4-pyrrolidinophenyl)ethylene, 1,1-bis(2-methyl-4-piperidinophenyl)ethylene, 1,1-bis(2-methyl-4-morpholinophenyl)ethylene, 1,1-bis(2-methyl-4-hexamethyleneiminophenyl)ethylene, 1,1-bis(2-methoxy-4-pyrrolidinophenyl)ethylene, 1,1-bis(2-methoxy-4-piperidinophenyl)ethylene, 1,1-bis(2-methoxy-4-morpholinophenyl)ethylene, 1,1-bis(2-methoxy-4-hexamethyleneiminophenyl)ethylene, 1-(4-pyrrolidinophenyl)-1-(4-dimethylaminophenyl)ethylene, 1-(4-piperidinophenyl)-1-(4-dimethylaminophenyl)ethylene, 1-(4-morpholinophenyl)-1-(4-dimethylaminophenyl)ethylene, 1-(4-hexamethyleneiminophenyl)-1-(4-dimethylaminophenyl)ethylene, 1-(4-pyrrolidinophenyl)-1-(4-N-ethyl-N-benzylaminophenyl)ethylene, 1-(4-piperidinophenyl)-1-(4-N-ethyl-N-benzylaminophenyl)ethylene, 1-(4-morpholinophenyl)-1-(4-N-ethyl-N-benzylaminophenyl)ethylene, 1-(4-hexamethyleneiminophenyl)-1-(4-N-ethyl-N-benzylaminophenyl)ethylene, 1-(4-pyrrolidinophenyl)-1-(4-N-methyl-N-p-tolylaminophenyl-)ethylene, 1-(4-piperidinophenyl)-1-(4-N-methyl-N-p-tolylaminophenyl)ethylene, 1-(4-morpholinophenyl)-1-(4-N-methyl-N-p-tolylaminophenyl)ethylene, 1-(4-hexamethyleneiminophenyl)-1-(4-N-methyl-N-p-tolylaminophenyl)ethylene, 1-(4-pyrrolidinophenyl)-1-(2-methyl-4-diethylaminophenyl)ethylene, 1-(4-pyrrolidinophenyl)-1-(2-methoxy-4-diethylaminophenyl-)ethylene, 1,1-bis(4-pyrrolidinophenyl)-1-propene, 1,1-bis(4-piperidinophenyl)-1-propene, 1,1-bis(4-morpholinophenyl)-1-propene, 1,1-bis(4-hexamethyleneiminophenyl)-1-propene, 1,1-bis(julolidine-9-yl)ethylene, 1,1-bis(1-methyl-1,2,3,4-tetrahydroquinoline-6-yl)ethylene, 1,1-bis(4-dimethylamino-3-methylphenyl)ethylene, 1,1-bis(4-diethylamino-2,3-dimethylphenyl)ethylene, 1,1-bis(4-dimethylamino-3-methoxyphenyl)ethylene, 1,1-bis(4-diethylamino-3,6-dimethoxyphenyl)ethylene, 1,1-bis(4-dimethylamino-3-chlorophenyl)-1-propene, 1,1-bis(4-diethylamino-3-methylphenyl)-1-propene, 1,1-bis(4-dimethylamino-2,3-dimethoxyphenyl)-1-propene, 1,1-bis(4-diethylamino-3-methoxyphenyl)-1-propene, 1,1-bis(4-pyrrolidino-3-methylphenyl)ethylene, 1,1-bis(4-morpholino-3-ethylphenyl)ethylene, 1,1-bis(2-chloro-4-hexamethyleneiminophenyl)ethylene, 1,1-bis(4-pyrrolidino-3-propoxyphenyl)ethylene, 1,1-bis(4-piperidino-3-methoxyphenyl)ethylene, 1,1-bis(4-morpholino-2,3-dichlorophenyl)ethylene, 1,1-bis(3-methoxy-4-hexamethyleneiminophenyl)ethylene, 1-(4-pyrrolidinophenyl)-1-(3-methyl-4-diethylaminophenyl)ethylene, 1-(4-pyrrolidinophenyl)-1-(3-ethoxy-4-diethylaminophenyl-)ethylene, 1,1-bis(4-methoxyphenyl)ethylene, 1,1-bis(4-ethoxyphenyl)ethylene, 1,1-bis(4-phenoxyphenyl)ethylene, 1,1-bis(4-p-chlorophenoxyphenyl)ethylene, 1,1-bis(4-butoxyphenyl)ethylene, 1,1-bis(4-phenethyloxyphenyl)ethylene, 1,1-bis(4-o-methylphenoxyphenyl-)ethylene, 1,1-bis(4-cyclohexyloxyphenyl)ethylene, 1,1-bis(4-p-methoxyphenoxyphenyl)ethylene, 1,1-bis(4-isopropoxyphenyl)ethylene, 1,1-bis(2-methyl-4-ethoxyphenyl)ethylene, 1,1-bis(3-chloro-4-ethoxyphenyl)ethylene, 1,1-bis(2,3-dimethyl-4-methoxyphenyl)ethylene, 1,1-bis(3-methoxy-4-phenoxyphenyl)ethylene, 1,1-bis(2-fluoro-4-cyclohexyloxyphenyl)ethylene, 1,1-bis(2,5-dimethyl-4-benzyloxyphenyl)ethylene, 1-(4-methoxyphenyl)-1-(4-ethoxyphenyl)ethylene, 1-(4-phenoxyphenyl)-1-(4-methoxyphenyl)ethylene, 1-(2-methyl-4-methoxyphenyl)-1-(4-ethoxyphenyl)ethylene, 1-phenyl-1-(4-dimethylaminophenyl)ethylene, 1-phenyl-1-(4-pyrrolidinophenyl)ethylene, 1-(4-methoxyphenyl)-1-(4-dimethylaminophenyl)ethylene, 1-(4-ethoxyphenyl)-1-(4-dimethylaminophenyl)ethylene, 1-(4-methoxyphenyl)-1-(4-pyrrolidinophenyl)ethylene, 1-(4-phenoxyphenyl)-1-(4-pyrrolidinophenyl)ethylene, 1-(4-ethoxyphenyl)-1-(4-diethylaminophenyl)ethylene, 1-(4-butoxyphenyl)-1-(4-piperidinophenyl)ethylene, 1-(2-methyl-4-methoxyphenyl)-1-(4-dimethylaminophenyl)ethylene, 1-(2-methyl-4-methoxyphenyl)-1-(4-pyrrolidinophenyl-)ethylene, 1-(3-chloro-4-ethoxyphenyl)-1-(4-aminophenyl)ethylene, 1-(4-methoxyphenyl)-1-(2-methyl-4-pyrrolidinophenyl)ethylene, 1-(4-ethoxyphenyl)-1-(3-ethoxy-4-diethylaminophenyl)ethylene, 1,1-bis(4-methoxyphenyl)-1-propene, 1,1-bis(4-ethoxyphenyl)-1-propene, 1,1-bis(4-p-chlorophenoxyphenyl)-1-propene, 1,1-bis(4-phenethyloxyphenyl)-1-propene, 1,1-bis(2-methyl-4-ethoxyphenyl)-1-propene, 1,1-bis(3-methoxy-4-phenoxyphenyl)-1-propene, 1,1-bis(2,5-dimethyl-4-benzyloxyphenyl)-1-propene, 1-(4-methoxyphenyl)-1-(4-dimethylaminophenyl)-1-propene, 1-(4-ethoxyphenyl)-1-(4-pyrrolidinophenyl)-1-propene, 1-(4-ethoxyphenyl)-1-(4-diethylaminophenyl)-1-propene, 1-(4-butoxyphenyl)-1-(4-piperidinophenyl)-1-propene, 1-(2-methyl-4-methoxyphenyl)-1-(4-dimethylaminophenyl)-1-propene, 1-(3-chloro-4-ethoxyphenyl)-1-(4-aminophenyl)-1-propene, 1-(4-ethoxyphenyl)-1-(3-ethoxy-4-diethylaminophenyl)-1-propene, 1,1-bis(4-aminophenyl)-1,3-butadiene, 1,1-bis(4-methylaminophenyl)-1,3-butadiene, 1,1-bis(4-dimethylaminophenyl)-1,3-butadiene, 1,1-bis(4-ethylaminophenyl)-1,3-butadiene, 1,1-bis(4-diethylaminophenyl)-1,3-butadiene, 1,1-bis(4-dimethylaminophenyl)-1,3-pentadiene, 1,1-bis(4-diethylaminophenyl)-1,3-pentadiene, 1,1-bis(4-dimethylamino-2-methylphenyl)-1,3-pentadiene, 1,1-bis(4-diethylamino-2-methylphenyl)-1,3-pentadiene, 1,1-bis(4-dimethylamino-2-methoxyphenyl)-1,3-pentadiene, 1,1-bis{4-(N-methyl-N-benzyl)aminophenyl}-1,3-butadiene, 1,1-bis{4-(N-ethyl-N-benzyl)aminophenyl}-1,3-butadiene, 1,1-bis{4-(N-ethyl-N-p-chlorobenzyl-)aminophenyl}-1,3-butadiene, 1,1-bis{4-(N-methyl-N-phenyl)aminophenyl}-1,3-butadiene, 1,1-bis{4-(N-methyl-N-p-tolyl)aminophenyl}-1,3-butadiene, 1,1-bis{4-(N-methyl-N-p-methoxyphenyl)aminophenyl}-1,3-butadiene, 1,1-bis{4-(N-ethyl-N-p-methoxyphenyl-)aminophenyl}-1,3-butadiene, 1,1-bis(4-dimethylamino-2-methylphenyl)-1,3-pentadiene, 1,1-bis(4-diethylamino-2-methylphenyl)-1,3-pentadiene, 1,1-bis(4-dimethylamino-2-methoxyphenyl)-1,3-pentadiene, 1,1-bis(4-diethylamino-2-methoxyphenyl)-1,3-pentadiene, 1,1-bis(4-pyrrolidinophenyl)-1,3-butadiene, 1,1-bis(4-piperidinophenyl)-1,3-butadiene, 1,1-bis(4-morpholinophenyl)-1,3-butadiene, 1,1-bis(4-hexamethyleneiminophenyl)-1,3-butadiene, 1,1-bis(2-methyl-4-pyrrolidinophenyl)-1,3-butadiene, 1,1-bis(2-methyl-4-piperidinophenyl)-1,3-butadiene, 1,1-bis(2-methyl-4-morpholinophenyl)-1,3-butadiene, 1,1-bis(2-methyl-4-hexamethyleneiminophenyl)-1,3-butadiene, 1,1-bis(2-methoxy-4-pyrrolidinophenyl)-1,3-butadiene, 1,1-bis(2-methoxy-4-piperidinophenyl)-1,3-butadiene, 1,1-bis(2-methoxy-4-morpholinophenyl)-1,3-butadiene, 1,1-bis(2-methoxy-4-hexamethyleneiminophenyl)-1,3-butadiene, 1-(4-pyrrolidinophenyl)-1-(4-dimethylaminophenyl)-1,3-butadiene, 1-(4-piperidinophenyl)-1-(4-dimethylaminophenyl)-1,3-butadiene, 1-(4-morpholinophenyl)-1-(4-dimethylaminophenyl)-1,3-butadiene, 1-(4-hexamethyleneiminophenyl)-1-(4-dimethylaminophenyl)-1,3-butadiene, 1-(4-pyrrolidinophenyl)-1-(4-N-ethyl-N-benzylaminophenyl)-1,3-butadiene, 1-(4-morpholinophenyl)-1-(4-N-ethyl-N-benzylaminophenyl)-1,3-butadiene, 1-(4-hexamethyleneiminophenyl)-1-(4-N-ethyl-N-benzylaminophenyl)-1,3-butadiene, 1-(4-pyrrolidinophenyl)-1-(4-N-methyl-N-p-tolylaminophenyl)-1,3-butadiene, 1-(4-piperidinophenyl)-1-(4-N-methyl-N-p-tolylaminophenyl)-1,3-butadiene, 1-(4-morpholinophenyl)-1-(4-N-methyl-N-p-tolylaminophenyl)-1,3-butadiene, 1-(4-hexamethyleneiminophenyl)-1-(4-N-methyl-N-p-tolylaminophenyl)-1,3-butadiene, 1-(4-pyrrolidinophenyl)-1-(2-methyl-4-diethylaminophenyl)-1,3-butadiene, 1-(4-pyrrolidinophenyl)-1-(2-methoxy-4-diethylaminophenyl)-1,3-butadiene, 1,1-bis(4-pyrrolidinophenyl)-1,3-pentadiene, 1,1-bis(4-morpholinophenyl)-1,3-hexadiene, 1,1-bis(4-hexamethyleneiminophenyl)-1,3-hexadiene, 1,1-bis(julolidine-9-yl)-1,3-butadiene, 1,1-bis(1-methyl-1,2,3,4-tetrahydroquinoline-6-yl)-1,3-butadiene, 1,1-bis(4-dimethylamino-3-methylphenyl)-1,3-butadiene, 1,1-bis(4-diethylamino-2,3-dimethylphenyl)-1,3-butadiene, 1,1-bis(4-dimethylamino-3-methoxyphenyl)-1,3-butadiene, 1,1-bis(4-diethylamino-3,6-dimethoxyphenyl)-1,3-butadiene, 1,1-bis(4-dimethylamino-3-chlorophenyl)-1,3-pentadiene, 1,1-bis(4-diethylamino-3-methylphenyl)-1,3-heptadiene, 1,1-bis(4-dimethylamino-2,3-dimethoxyphenyl)-1,3-pentadiene, 1,1-bis(4-diethylamino-3-methoxyphenyl)-1,3-pentadiene, 1,1-bis(4-pyrrolidino-3-methylphenyl)-1,3-butadiene, 1,1-bis(4-morpholino-3-ethylphenyl)-1,3-butadiene, 1,1-bis(2-chloro-4-hexamethyleneimino-phenyl)-1,3-butadiene, 1,1-bis(4-pyrrolidino-3-propoxy-phenyl)-1,3-butadiene, 1,1-bis(4-piperidino-3-methoxy-phenyl)-1,3-butadiene, 1,1-bis(4-morpholino-2,3-dichlorophenyl)-1,3-butadiene, 1,1-bis(3-methoxy-4-hexamethyleneimonophenyl)-1,3-butadiene, 1-(4-pyrrolidinophenyl)-1-(3-methyl-4-diethylaminophenyl)-1,3-butadiene, 1-(4-pyrrolidinophenyl)-1-(3-ethoxy-4-diethylaminophenyl)-1,3-butadiene, 1,1-bis(4-methoxyphenyl)-1,3-butadiene, 1,1-bis(4-ethoxyphenyl)-1,3-butadiene, 1,1-bis(4-phenoxyphenyl)-1,3-butadiene, 1,1-bis(4-p-chlorophenoxyphenyl)-1,3-butadiene, 1,1-bis(4-butoxyphenyl)-1,3-butadiene, 1,1-bis(4-phenethyloxyphenyl)-1,3-butadiene, 1,1-bis(4-o-methylphenoxyphenyl)-1,3-butadiene, 1,1-bis(4-cyclohexyloxyphenyl)-1,3-butadiene, 1,1-bis(4-p-methoxyphenoxyphenyl)-1,3-butadiene, 1,1-bis(4-isopropoxyphenyl)-1,3-butadiene, 1,1-bis(2-methyl-4-ethoxyphenyl)-1,3-butadiene, 1,1-bis(3-chloro-4-ethoxyphenyl)-1,3-butadiene, 1,1-bis(2,3-dimethyl-4-methoxyphenyl)-1,3-butadiene, 1,1-bis(3-methoxy-4-phenoxyphenyl)-1,3-butadiene, 1,1-bis(2-fluoro-4-cyclohexyloxyphenyl)-1,3-butadiene, 1,1-bis(2,5-dimethyl-4-benzyloxyphenyl)-1,3-butadiene, 1-(4-methoxyphenyl)-1-(4-ethoxyphenyl)-1,3-butadiene, 1-(4-phenoxyphenyl)-1-(4-methoxyphenyl)-1,3-butadiene, 1-(2-methyl-4-methoxyphenyl)-1-(4-ethoxyphenyl)-1,3-butadiene, 1-(4-methoxyphenyl)-1-(4-dimethylaminophenyl)-1,3-butadiene, 1-(4-ethoxyphenyl)-1-(4-dimethylaminophenyl)-1,3-butadiene, 1-(4-methoxyphenyl)-1-(4-pyrrolidinophenyl)-1,3-butadiene, 1-(4-phenoxyphenyl)-1-(4-pyrrolidinophenyl)-1,3-butadiene, 1-(4-ethoxyphenyl)-1-(4-diethylaminophenyl)-1,3-butadiene, 1-(4-butoxyphenyl)-1-(4-piperidinophenyl)-1,3-butadiene, 1-(2-methyl-4-methoxyphenyl)-1-(4-dimethylaminophenyl)-1,3-butadiene, 1-(2-methyl-4-methoxyphenyl)-1-(4-pyrrolidinophenyl)-1,3-butadiene, 1-(3-chloro-4-ethoxyphenyl)-1-(4-aminophenyl)-1,3-butadiene, 1-(4-methoxyphenyl)-1-(2-methyl-4-pyrrolidinophenyl)-1,3-butadiene, 1-(4-ethoxyphenyl)-1-(3-ethoxy-4-diethylaminophenyl)-1,3-butadiene, 1,1-bis(4-methoxyphenyl)-1,3-pentadiene, 1,1-bis(4-ethoxyphenyl)-1,3-hexadiene, 1,1-bis(4-p-chlorophenoxyphenyl)-1,3-pentadiene, 1,1-bis(4-phenethyloxyphenyl)-1,3-pentadiene, 1,1-bis(2-methyl-4-ethoxyphenyl)-1,3-pentadiene, 1,1-bis(3-methoxy-4-phenoxyphenyl)-1,3-pentadiene, 1,1-bis(2,5-dimethyl-4-benzyloxyphenyl)-1,3-pentadiene, 1-(4-methoxyphenyl)-1-(4-dimethylaminophenyl)-1,3-pentadiene, 1-(4-ethoxyphenyl)-1-(4-pyrrolidinophenyl)-1,3-pentadiene, 1-(4-ethoxyphenyl)-1-(4-diethylaminophenyl)-1,3-hexadiene, 1-(4-butoxyphenyl)-1-(4-piperidinophenyl)-1,3-pentadiene, 1-(2-methyl-4-methoxyphenyl)-1-(4-dimethylaminophenyl)-1,3-pentadiene, 1-(3-chloro-4-ethoxyphenyl)-1-(4-aminophenyl)-1,3-pentadiene, 1-(4-ethoxyphenyl)-1-(3-ethoxy-4-diethylaminophenyl)-1,3-pentadiene, etc.

The above diphenylalkene derivative of the formula [I] used as a coupler compound in the invention is used singly to exhibit the above-mentioned excellent properties, but is usable, as required, in a mixture of at least two of them.

Further, the conventional coupler compounds can be conjointly used in a desired amount which does not cause adverse effects to form record images having a desired color. Examples of useful conventional coupler compounds are catechol, phenol, resorcin, methylresorcin, 4,4-bisresorcin, phloroglucin, resorcylic acid, phloroglucinolcarboxylic acid, 2-methyl-5-methoxy-1,3-dihydroxybenzene, 5-methoxy-1,3-dihydroxybenzene, 4-N,N-dimethylphenol, 2,6-dimethyl-1,3,5-trihydroxybenzene, 2,6-dihydroxybenzoic acid, 2,6-dihydroxy-3,5-dibromo-4-methoxybenzoic acid and like phenol derivatives; α-naphthol, β-naphthol, 4-methoxy-1-naphthol, 1,5-dihydroxynaphthalene, 2,3-dihydroxynaphthalene, sodium 2,3-dihydroxynaphthalene-6-sulfonate, 2-hydroxy-3-propylmorpholinonaphthoic acid, 2-hydroxy-3-naphtho-o-toluidide, 2-hydroxy-3-naphthoic acidmorpholinopropylamide, naphthol AS and like naphthol derivatives; acetanilide, acetoacetanilide, 4-benzoylamino-2,5-diethoxyacetoacetanilide, N-acetoacetooctadecylamine, N,N'-bis(acetoaceto)decane-1,10-diamine, 2,4,6-tribromoacetoacetanilide and like active methylene compounds, etc. The coupler compounds are not limited to the above and any of compounds is usable which acts as a coupler to a diazonium salt to form an azo dye.

Many compounds are known as a diazonium salt which reacts with a coupler compound to form an azo dye. At least one of the diazonium salt and the coupler compound melts with heating and they react to form an azo dye. The unreacted diazonium salt decomposes with irradiation of ultraviolet ray. Examples of useful diazonium salts are complex salts of zinc chloride and chloride of the diazonium compound such as 4-dimethylaminobenzenediazonium, 4-morpholino-2,5-dibutoxybenzenediazonium, 4-(4-methoxy)benzylamino-2,5-diethoxybenzenediazonium, 4-morpholinobenzenediazonium, 4-pyrrolidino-3-methylbenzenediazonium, 4-(N-ethyl-N-hydroxyethyl-)anilinediazonium, 4-benzamide-2,5-diethoxybenzenediazonium, 4-diethylamino-3-methylbenzenediazonium, 4-morpholino-3-methylbenzenediazonium, 4-morpholino-2,5-diisopropoxybenzenediazonium, 4-morpholino-2,5-diethoxybenzenediazonium, 4-diethylaminobenzenediazonium, 4-dipropylaminobenzene-diazonium, 4-methylbenzylaminobenzenediazonium, 4-dibenzylaminobenzenediazonium, 4-diethylamino-2-methoxybenzenediazonium, 4-dimethylamino-3-methylbenzenediazonium, 4-morpholino-2,5-diethoxybenzenediazonium, 4-anilinobenzenediazonium, 4-dimethylamino-2-carboxybenzenediazonium, 4-toluylmercapto-2,5-diethoxybenzenediazonium, 4-ethoxyphenylmercapto-2,5-dibutoxybenzenediazonium, 4-methoxyphenylmercapto-2,5-diethoxybenzenediazonium, 4-benzylmercapto-2,5-dimethoxybenzenediazonium, 4-methylbenzylamino-2-phenoxy-5-ethoxybenzenediazonium, 4-dibenzylamino-2-chlorobenzenediazonium, 4-phenoxybenzenediazonium, 4-phenoxy-2-methylbenzenediazonium, etc.; borotetraphenyl salts, borotetrafluorides, phosphohexafluorides of the above diazonium compounds, etc. The diazonium compound is not limited to the above compounds.

In the invention are used, as required, a basic compound which is hardly soluble in water or a substance which produces a basic atmosphere upon heating as an auxiliary color former, in order to accelerate the reaction between the coupler compound of the formula [I] and the diazonium salt. Examples thereof are octadecylbenzylamine, tricyclohexylamine, tribenzylamine, stearylamine and like organic amines; ammonium acetate and like inorganic or organic ammonium salts; allylurea, thiourea, methylthiourea, allylthiourea, ethylenethiourea and like ureas, thioureas or derivatives thereof; benzimidazole, 2-benzylimidazole, 2-phenyl-4-methylimidazole and like imidazoles; 2-undecylimidazoline, 2,4,5-triphenyl-2-imidazoline, 1,2-diphenyl-4,4-dimethyl-2-imidazoline, 2-phenyl-2-imidazoline and like imidazolines; 1,2,3-triphenylguanidine, 1,2-ditolylguanidine, 1,2-dicyclohexylguanidine, 1,2,3-tricyclohexylguanidine, 1,3-dicyclohexyl-2-phenylguanidine, guanidine salt of trichloroacetic acid and like guanidines; 2-amino-benzothiazole, 2-benzoylhydrazino-benzothiazole and like thiazoles; N,N-dibenzylpiperazine and like piperazines; N,N'-diphenylformamidine, N,N',N'',N'''-tetraphenyl-terephthalamidine and like amidines; 4,4'-dithiomorpholine, morpholinium salt of trichloroacetic acid and like morpholines; amides, pyrroles, pyrimidines, triazoles, piperidines, pyridines and like nitrogen-containing compounds. These auxiliary color former can be, as required, used in mixture of at least two of them.

Further, a heat-fusible compound can be used as a recording sensitizer in order to obtain high-speed recording ability. Examples of useful heat-fusible compounds are caproic amide, capric amide, palmitic amide, stearic amide, oleic amide, erucic amide, linoleic amide, linolenic amide, N-methylstearic amide, stearic anilide, N-methyloleic amide, linoleic anilide, N-ethylcapric amide, N-butyllauric amide, N-octadecylacetamide, N-oleyl acetamide, N-oleylbenzamide, N-stearylcyclohexyl amide, polyethylene glycol, 1-benzyloxynaphthalene, 1-hydroxynaphthoic acid phenyl ester, 1,2-diphenoxyethane, 1,4-diphenoxybutane, 1,2-di(3-methylphenoxy)ethane, 1-phenoxy-2-(4-chlorophenoxy)ethane, 1-phenoxy-2-(4-methoxyphenoxy)ethane, etc. Further, various known recording sensitizers are conjointly usable.

The present heat-sensitive recording material is generally prepared by applying to a substrate a coating composition for a recording layer which is obtained by dispersing into water fine particles of a diazonium salt, coupler compound containing a diphenylalkene derivative of the formula [I], auxiliary color former, recording sensitizer, etc.

The proportions of the diazonium salt and coupler compound to be used in the coating composition are not particularly limited but preferably 0.1 to 10 parts by weight of the coupler compound are used per one part by weight of the diazonium salt.

Although auxiliary color former is not necessarily used, it is used, when used, in an amount of 0.5 to 30 parts by weight, preferably 1 to 10 parts by weight per one part by weight of the diazonium salt. The amount of the recording sensitizer varies depending on the desired sensitivity and is not necessarily limited but is generally 0.5 to 30 parts by weight, preferably 1 to 10 parts by weight per one part by weight of the diazonium salt.

To the coating composition are added, as desired, a preservative such as sodium naphthalenesulfonate, sodium naphthalenedisulfonate, sulfosalicylic acid, magnesium sulfate, zinc chloride, etc; antioxidant such as thiourea, diphenyl thiourea, urea, etc; stabilizer such as citric acid, malic acid, tartaric acid, phosphoric acid, saponin, etc; water-soluble or water-insoluble adhesive such as starches, casein, gum arabic, polyvinyl alcohols, polyvinyl acetate emulsion, SBR latex, etc; pigment such as silica, clay, barium sulfate, titanium oxide, calcium carbonate, etc; additives such as dispersing agent, ultraviolet ray absorbing agents, defoaming agent, fluorescent dye, colored dye, etc.

As described above, the present heat-sensitive recording material is prepared by applying to a substrate a coating composition having dispersed therein fine particles of a diazonium salt, coupler compound, auxiliary color former, recording sensitizer, etc. Alternatively, two coating compositions having dispersed a diazonium salt and coupler compound respectively are applied to a substrate one upon another. Further, the coating composition can be applied to a substrate by impregnation.

As disclosed in Unexamined Japanese Publication SHO 60-6493, when required, can be coated on a substrate a microcapsule containing an organic solvent having dissolved therein at least one of a diazonium salt, coupler compound and auxiliary color former, preferably a diazonium salt or coupler compound.

The method of preparing a coating composition and coating method are not particularly limited and the coating composition is applied in an amount of usually 2 to 12 g/m$^2$ based on dry weight. It is possible to form an overcoat layer on the recording layer in order to protect the recording layer or to form an under layer on a substrate. Further, various known techniques in the field of the heat-sensitive recording material are usable.

As a substrate are usable a paper, plastic film, synthetic fiber sheet, etc. but paper is preferably used in view of cost, coating characteristics, etc.

In the heat-sensitive recording material of the invention, record images are formed as usual with a thermal pen, thermal head or the like, and ultraviolet rays are irradiated thereto by use of luminescent lamp, mercury lamp or the like to decompose the unreacted diazonium salt in the unrecorded portion and fix the record images.

The invention will be described below in more detail with reference to Examples and Comparison Examples by no means limited to, in which parts and percentages are all by weight, unless otherwise specified.

EXAMPLE 1

(1) Composition (A)

4-Morpholino-2,5-diethoxybenzenediazonium borotetraphenyl salt (2 parts), 50 parts of calcium carbonate, 50 parts of 10% aqueous solution of polyvinyl alcohol and 100 parts of water were pulverized by a sand mill to prepare Composition (A) having an average particle size of 3 μm.

(2) Composition (B)

1,1-Bis(4-dimethylaminophenyl)ethylene (10 parts), 20 parts of N,N',N'',N'''-tetraphenyl-terephthalamidine, 25 parts of 1,4-diphenoxybutane, 50 parts of 10% aqueous solution of polyvinyl alcohol and 150 parts of water were pulverized by a sand mill to prepare Composition (B) having an average particle size of 3 μm.

(3) Preparation of a recording layer

A 202-part quantity of Composition (A) and 255 parts of Composition (B) were mixed with stirring to prepare a coating composition. The coating composition was applied by a Mayer bar to a paper substrate weighing 49 g/m$^2$ in an amount of 7 g/m$^2$ by dry weight to prepare a heat-sensitive recording paper.

The obtained recording paper was pressed to a plate heated at 120° C. at a pressure of 4 kg/cm$^2$ for 5 seconds to produce record images. The images were fixed with irradiation of fluorescent lamp to obtain reddish black images. The light absorption spectrum of the record images showed a broad and strong absorption over a range of 420 to 840 nm.

EXAMPLE 2

A heat-sensitive recording paper was prepared in the same manner as in Example 1 except that, in the preparation of Composition (B), 1,1-bis(4-pyrrolidinophenyl-)ethylene was used in place of 1,1-bis(4-dimethylaminophenyl)ethylene. The recording paper was treated in the same manner as in Example 1 to obtain reddish black images. The light absorption spectrum of the record images showed a broad and strong absorption over a range of 420 to 850 nm.

EXAMPLE 3

A heat-sensitive recording paper was prepared in the same manner as in Example 1 except that N,N',N'',N'''-tetraphenyl-terephthalamidine was not used in the preparation of Composition (B). The recording paper was treated similarly and gave greenish blue images. The light absorption spectrum of the record images showed a broad and strong absorption over a range of 550 to 890 nm.

EXAMPLE 4

A heat-sensitive recording paper was prepared in the same manner as in Example 1 except that 1,4-diphenoxybutane was not used in the preparation of Composition (B). The recording paper was treated similarly and gave reddish black images. The light absorption spectrum of the record images showed a broad and strong absorption over a range of 420 to 840 nm.

EXAMPLE 5

A heat-sensitive recording paper was prepared in the same manner as in Example 3 except that 1,1-bis(4-isopropoxyphenyl)ethylene was used in place of 1,1-bis(4-dimethylaminophenyl)ethylene. The recording paper was treated similarly and gave yellowish brown images. The light absorption spectrum showed a strong absorption over a range of 400 to 510 nm and a broad absorption 600 to 800 nm.

EXAMPLES 6 TO 18

Thirteen kinds of heat-sensitive recording papers were prepared in the same manner as in Example 3 except that, in place of 1,1-bis(4-dimethylaminophenyl-)ethylene in the preparation of Composition (B), the diphenylalkene derivatives listed in Table 1 were used. The obtained recording papers were treated similarly to form record images. Table 1 also shows a color and light absorption data of the record images.

TABLE 1

| | Diphenylalkene derivative | Color | Light Absorption (nm) |
|---|---|---|---|
| Ex. 6 | 1,1-bis(4-N—ethyl-N—benzylaminophenyl)ethylene | bluish black | 545~885 |
| Ex. 7 | 1,1-bis(4-N—methyl-N—cyclohexylaminophenyl)ethylene | bluish black | 550~890 |
| Ex. | 1,1-bis(4-N—methyl-N— | bluish | 540~880 |

TABLE 1-continued

| | Diphenylalkene derivative | Color | Light Absorption (nm) |
|---|---|---|---|
| 8 | p-tolylaminophenyl)ethylene | black | |
| Ex. | 1-(4-diethylaminophenyl)- | bluish | 540~880 |
| 9 | 1-(4-morpholinophenyl)ethylene | black | |
| Ex. | 1-(4-diethylaminophenyl)- | bluish | 545~885 |
| 10 | 1-(4-pyrrolidinophenyl)ethylene | black | |
| Ex. | 1-(4-methoxyphenyl)-1-(4- | blackish | 400~565 |
| 11 | pyrrolidinophenyl)ethylene | red | 650~830 |
| Ex. | 1-phenyl-1-(4- | blackish | 410~560 |
| 12 | pyrrolidinophenyl)ethylene | red | 650~835 |
| Ex. | 1-(4-methoxy-2-methylphenyl)- | blackish | 410~565 |
| 13 | 1-(4-dimethylaminophenyl)ethylene | red | 640~825 |
| Ex. | 1-(4-dimethylaminophenyl)-1-(4- | bluish | 540~885 |
| 14 | pyrrolidino-2-methylphenyl)-ethylene | black | |
| Ex. | 1-(4-dimethylamino-2-chlorophenyl)- | bluish | 540~880 |
| 15 | 1-(4-pyrrolidinophenyl)ethylene | black | |
| Ex. | 1-(4-diethylamino-2-methoxyphenyl)- | bluish | 545~885 |
| 16 | 1-(4-diethylaminophenyl)ethylene | black | |
| Ex. | 1,1-bis(4-dimethylaminophenyl)- | bluish | 545~885 |
| 17 | 1-propene | black | |
| Ex. | 1,1-bis(4-dimethylaminophenyl)- | black | 540~905 |
| 18 | 1,3-butadiene | | |

EXAMPLES 19 TO 23

Five kinds of heat-sensitive recording papers were prepared in the same manner as in Example 1 except that, in place of 4-morpholino-2,5-diethoxybenzenediazonium borotetraphenyl salt in the preparation of Composition (A), the diazonium salts listed in Table 2 were used. The obtained recording papers were treated similarly to form record images. Table 2 also shows a color and light absorption data of the record images.

TABLE 2

| | Diazonium salt | Color | Light Absorption (nm) |
|---|---|---|---|
| Ex. 19 | 4-morpholino-2,5-dibutoxy-benzenediazonium borotetra-phenyl salt | reddish black | 420~840 |
| Ex. 20 | 4-diethylamino-2-methoxy-benzenediazonium borotetra-phenyl salt | reddish black | 420~850 |
| Ex. 21 | 4-benzamide-2,5-diethoxy-benzenediazonium phospho-hexafluoride salt | brown | 420~520<br>600~825 |
| Ex. 22 | 4-toluylmercapto-2,5-diethoxybenzenediazonium borotetraphenyl salt | brown | 420~515<br>605~815 |
| Ex. 23 | 4-phenoxy-2-methylbenzene-diazonium borotetraphenyl salt | brown | 420~510<br>610~810 |

EXAMPLE 24

Composition (A) obtained in the same manner as in Example 1 was applied by a Mayer bar to a paper substrate weighing 49 g/m$^2$ in an amount of 3 g/m$^2$ by dry weight and dried. Thereto was applied Composition (B) obtained in the same manner as in Example 1 in an amount of 4 g/m$^2$ by dry weight and dried to prepare a heat-sensitive recording paper. The recording paper was treated similarly and gave reddish black images. The light absorption spectrum of the record images showed a broad and strong absorption over a range of 420 to 840 nm.

EXAMPLE 25

In 12 parts of tricresyl phosphate were dissolved 4 parts of 4-morpholino-2,5-diethoxybenzenediazonium phosphohexafluoride salt and 18 parts of an adduct of xylylene diisocyanate and trimethylolpropane (3:1). The above solution containing diazonium salt was added to an aqueous solution of 5.2 parts of polyvinyl alcohol in 58 parts of water at 20° C. to obtain an emulsion containing particles 2.5$\mu$ in average size. To the emulsion was added 100 parts of water and the mixture was heated at 60° C. with stirring for 2 hours to prepare a capsule dispersion containing the diazonium salt as a core material.

To 100 parts of 5% aqueous solution of polyvinyl alcohol were added 10 parts of 1,1-bis(4-pyrrolidinophenyl)ethylene and 10 parts of triphenylguanidine. The mixture was pulverized by a sand mill to obtain a dispersion of particles 3 $\mu$m in average size containing the coupler compound and auxiliary color former. Further, 10 parts of hydroquinone monobenzyl ether was added to 100 parts of 5% aqueous solution of polyvinyl alcohol and the mixture was pulverized by a sand mill to prepare a dispersion of particles 3 $\mu$m in average size containing hydroquinone monobenzyl ether.

To 50 parts of the capsule dispersion containing the diazonium salt were added 24 parts of the dispersion containing the coupler compound and auxiliary color former and 30 parts of the dispersion containing hydroquinone monobenzyl ether to prepare a coating composition. The coating composition was applied by a Mayer bar to a paper substrate weighing 49 g/m$^2$ in an amount of 6 g/m$^2$ by dry weight and dried to prepare a heat-sensitive recording paper.

The obtained recording paper was pressed to a plate heated at 130° C. at a pressure of 4 kg/cm$^2$ for 5 seconds to produce record images. The images were fixed with irradiation of ultraviolet lamp to obtain reddish black images. The light absorption spectrum of the record images showed a broad and strong absorption over a range of 420 to 850 nm.

As apparent from Examples mentioned above, the present heat-sensitive recording material produces record images which have absorption over an infrared wavelength region and are readable by optical character-reading devices having a reading wavelength range over the infrared region.

We claim:

1. A heat-sensitive recording material which comprises a substrate and a heat-sensitive recording layer thereon consisting essentially of a coupler compound and a photosensitive diazonium salt which reacts with said coupler compound to form an azo dye, said coupler compound comprising at least one compound represented by the formula (I):

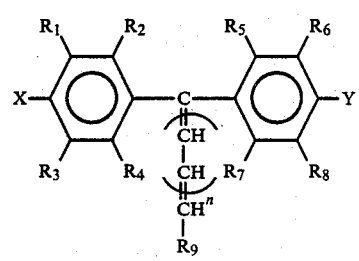

[I]

wherein $R_1$, $R_2$, $R_3$, $R_4$, $R_5$, $R_6$, $R_7$ and $R_8$ are each hydrogen, halogen, alkyl or alkoxyl; $R_9$ is hydrogen or alkyl; X and Y are each hydrogen, $-OR_{10}$ or $-N(R_{11})(R_{12})$, $R_{10}$, $R_{11}$ and $R_{12}$ being each hydrogen, alkyl, alicyclic, aryl or aralkyl, said alkyl, alicyclic, aryl or aralkyl being unsubstituted or substituted by a substituent selected from halogen, alkyl and alkoxyl, or $R_{11}$ and $R_{12}$ may link together to form a heterocyclic ring, or one or both of $R_{11}$ and $R_{12}$ may link together to form a heterocyclic ring together with an adjacent benzene ring; and n is 0 or 1, said coupler compound being used in an amount of 0.1 to 10 parts by weight per one part by weight of said diazonium salt.

2. A heat-sensitive recording material as claimed in claim 1 wherein at least one of X and Y is $-N(R_{11})(R_{12})$, wherein $R_{11}$ and $R_{12}$ are as defined in claim 9.

3. A heat-sensitive recording material as claimed in claim 1 wherein the coupler compound comprises at least one compound represented by the formula (II):

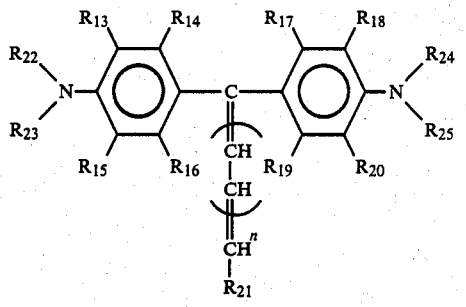

[II]

wherein $R_{13}$, $R_{14}$, $R_{15}$, $R_{16}$, $R_{17}$, $R_{18}$, $R_{19}$ and $R_{20}$ are each hydrogen, halogen, $C_1$–$C_4$ alkyl or $C_1$–$C_4$ alkoxyl; $R_{21}$ is hydrogen or methyl; $R_{22}$, $R_{23}$, $R_{24}$ and $R_{25}$ are each hydrogen, $C_1$ $C_4$ alkyl, $C_5$–$C_6$ cycloalkyl, phenyl or benzyl, said phenyl or benzyl being unsubstituted or substituted with halogen, $C_1$–$C_2$ alkyl or $C_1$–$C_2$ alkoxy, or both $R_{22}$ and $R_{23}$, and both $R_{24}$ and $R_{25}$ may link together to form a 5 to 7 membered heterocyclic ring; and n is 0 or 1.

4. A heat-sensitive recording material as claimed in claim 1 wherein n in the formula (I) is zero.

5. A heat-sensitive recording material as claimed in claim 3 wherein n in the formula (II) is zero.

6. A heat-sensitive recording material as claimed in claim 1 wherein $R_9$ in the formula (I) is hydrogen.

7. A heat-sensitive recording material as claimed in claim 3 wherein $R_{21}$ in the formula (II) is hydrogen.

* * * * *